US010207526B2

(12) United States Patent
Matsuzaki et al.

(10) Patent No.: US 10,207,526 B2
(45) Date of Patent: Feb. 19, 2019

(54) RECORDING APPARATUS

(71) Applicant: SEIKO EPSON CORPORATION, Tokyo (JP)

(72) Inventors: Kazutoshi Matsuzaki, Shiojiri (JP); Tetsuya Miyagawa, Shiojiri (JP); Shota Mizuno, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/653,941

(22) Filed: Jul. 19, 2017

(65) Prior Publication Data

US 2018/0029392 A1 Feb. 1, 2018

(30) Foreign Application Priority Data

Jul. 28, 2016 (JP) ..... 2016-148122

(51) Int. Cl.

| | |
|---|---|
| ***B41J 2/21*** | (2006.01) |
| ***B41J 2/175*** | (2006.01) |
| ***B41J 25/00*** | (2006.01) |
| ***B41J 29/02*** | (2006.01) |

(52) U.S. Cl.

CPC ..... *B41J 25/003* (2013.01); *B41J 2/1752* (2013.01); *B41J 2/17523* (2013.01); *B41J 2/17526* (2013.01); *B41J 2/17546* (2013.01); *B41J 2/17553* (2013.01); *B41J 2/2135* (2013.01); *B41J 29/02* (2013.01)

(58) Field of Classification Search

CPC ..... B41J 2/2135; B41J 2/17546

See application file for complete search history.

(56) References Cited

U.S. PATENT DOCUMENTS

| | | | | |
|---|---|---|---|---|
| 5,867,188 | A | 2/1999 | Murayama et al. | |
| 6,092,887 | A * | 7/2000 | Tanino | B41J 2/14024 347/37 |
| 7,484,825 | B2 * | 2/2009 | Asauchi | B41J 2/17526 347/19 |

FOREIGN PATENT DOCUMENTS

| | | | |
|---|---|---|---|
| JP | 08-258370 | A | 10/1996 |
| JP | 2004-050544 | A | 2/2004 |
| JP | 2005-193458 | A | 7/2005 |

* cited by examiner

*Primary Examiner* — Julian D Huffman
(74) *Attorney, Agent, or Firm* — Workman Nydegger

(57) ABSTRACT

A recording apparatus has a carriage in which a head unit including a recording head is disposed. By turning the head unit within the carriage about a pivot that extends in a direction intersecting a head surface, the angle of the recording head is adjusted while maintaining good contact between a data storage unit included in an ink cartridge and a contact terminal included in the carriage.

6 Claims, 15 Drawing Sheets

RECORDING APPARATUS

BACKGROUND

1. Technical Field

The present invention relates to recording apparatuses for recording onto media.

2. Related Art

One example of an ink jet printer, which is an example of a recording apparatus, is a serial type ink jet printer that has a carriage with a recording head mounted thereon. The serial type ink jet printer is formed so as to perform recording by ejecting liquid (or ink as an example of liquid) from the recording head onto a medium while the carriage moves reciprocally in the main scanning direction. The recording head in the carriage may be formed such that the mounting angle of the recording head can be adjusted, as described in JP-A-2004-050544.

The carriage disclosed in JP-A-2004-050544 consists of two units (a moving unit and a recording unit). The recording unit is turnably disposed with respect to the moving unit. By turning the recording unit with respect to the moving unit, the angle between the recording head and a medium in a sheet transport direction can be adjusted. The carriage according to JP-A-2004-050544 having the above described configuration can respond to a change of design, when necessary, by changing the design of the recording unit.

Some carriages of ink jet printers have ink cartridges installed therein, and the ink cartridges may have a data storage unit (IC chip) for storing information about ink, such as the remaining amount and the color of the ink. In this case, a contact terminal is provided on a carriage for electrically connecting to the data storage unit.

When the recording head is turned in order to adjust the angle of the recording head with respect to the sheet transport direction, the data storage unit may be displaced from the contact terminal. This may impede good contact between the data storage unit and the contact terminal, leading to a failure to read and write data properly with the data storage unit.

Moreover, by turning the recording head in order to adjust the angle of the recording head with respect to the sheet transport direction, the contact position between a supply portion of the ink cartridge for supplying ink and a receiving portion of the recording head for receiving the ink may be displaced, leading to a failure to supply ink smoothly to the recording head.

SUMMARY

An advantage of some aspects of the invention is that a recording apparatus is provided in which a carriage including a mechanism for adjusting the angle of a recording head enables smooth supply of ink from ink cartridges toward the recording head while maintaining good contact between a data storage unit and a contact terminal.

A recording apparatus according to a first aspect of the invention includes a carriage guided by a guiding device and being capable of moving in a reciprocating movement direction; a head unit held by the carriage and including a recording head that records onto a medium; a contact terminal included in the carriage and brought into contact with a data storage unit that is mounted on a liquid cartridge and stores information about the liquid cartridge; a positioner portion included in the carriage and maintaining contact between the contact terminal and the data storage unit when the liquid cartridge is installed into the carriage; and an adjustment mechanism that adjusts the position of the head unit with respect to the carriage, within a range in which the receiving portion included in the head unit can be connected to a supply portion included in the liquid cartridge, by turning the head unit about a pivot that extends in a direction intersecting a head surface of the recording head, the head surface having a nozzle for ejecting liquid.

In accordance with the first aspect, even if the head unit is turned with respect to the carriage, the position of the data storage medium included in the liquid cartridge remains unchanged relative to the contact terminal, or, if it changes, the change can be suppressed to a small amount. In other words, good contact between the data storage unit and the contact terminal can be maintained without dividing the carriage into two separate units. Moreover, the head unit can be turned within a range in which the receiving portion can be connected to the supply portion. Thus, liquid can be supplied smoothly from the liquid cartridge toward the recording head while maintaining good contact between the data storage unit and the contact terminal.

A second aspect of the invention is that, in the recording apparatus according to the first aspect, the receiving portion has a receiving surface to be brought into areal contact with the supply portion.

In accordance with the second aspect, the receiving portion is brought into areal contact with the supply portion so that, even if the head unit is turned, liquid is supplied smoothly from the supply portion to the receiving portion.

A third aspect of the invention is that, in the recording apparatus according to the first aspect, the receiving portion has a receiving stylus to be inserted into the supply portion so as to receive liquid, and the receiving stylus has elasticity.

In accordance with the third aspect, the receiving stylus included in the receiving portion has elasticity so that, even if the supply portion is connected to the receiving stylus of the receiving portion after the head unit is turned, damage to the supply portion or the receiving portion can be avoided.

A fourth aspect of the invention is that, in the recording apparatus according to the second aspect, when the head unit is viewed in a direction intersecting the head surface, the head unit has the pivot at one end thereof and has a pressed portion at another end thereof, and the adjustment mechanism presses the pressed portion so as to turn the head unit about the pivot.

In accordance with the fourth aspect, fine adjustment of the angle between the recording head and a print sheet with respect to a sheet transport direction can be implemented with a simple construction.

A fifth aspect of the invention is that, in the recording apparatus according to the fourth aspect, the head unit has the pivot at one end thereof in the reciprocating movement direction and has the pressed portion at the other end thereof, and the adjustment mechanism has a cam which presses the pressed portion.

In accordance with the fifth aspect, the head unit can be turned by the cam so that fine adjustment of the angle between the recording head and a print sheet with respect to the sheet transport direction can be implemented with a simple construction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments according to the invention will now be described with reference to the drawings. Note that like reference symbols denote like elements in each example. Such elements will be described only in relation to a first example and no further description will be provided in the subsequent examples.

Figure 1:
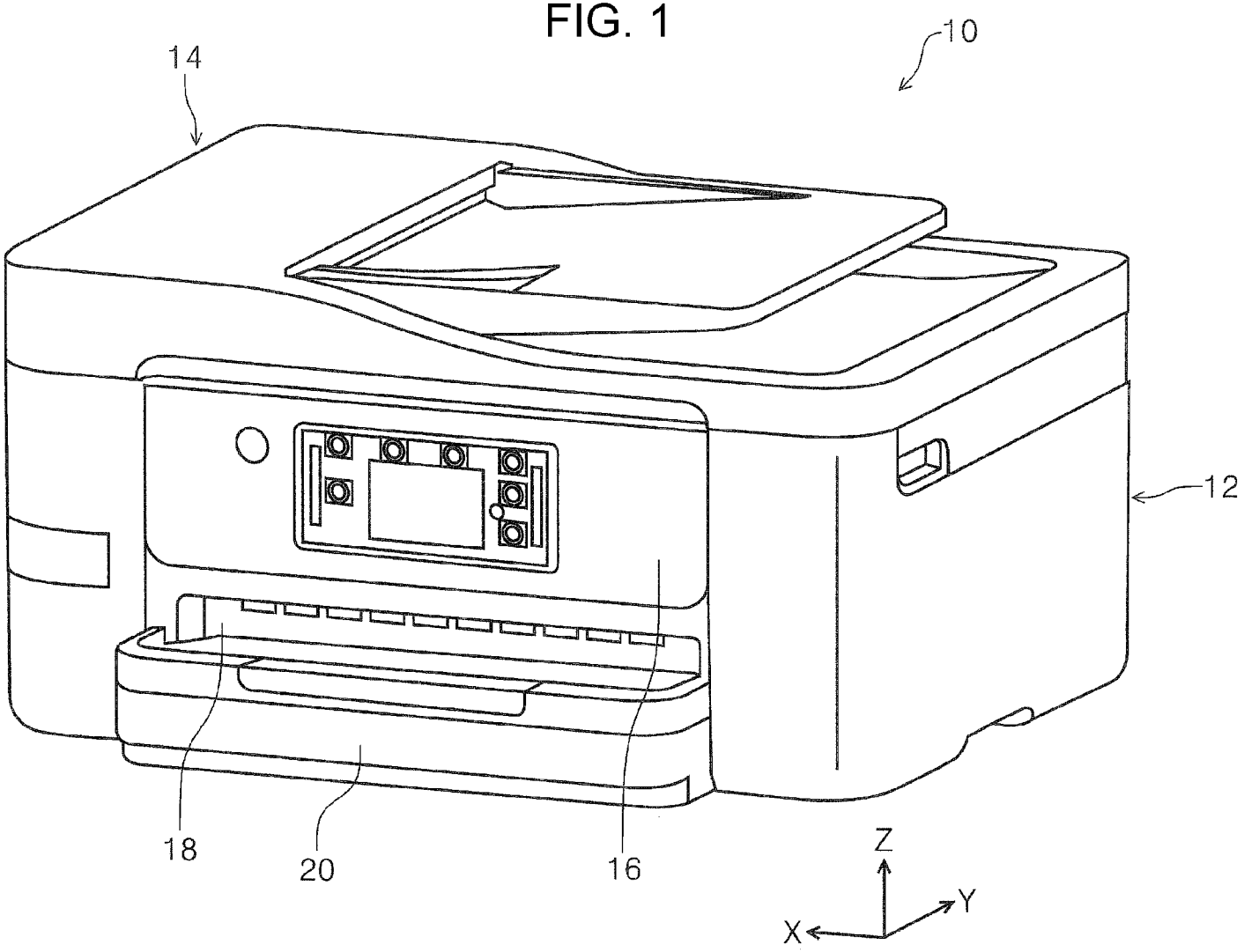
FIG. 1 is a perspective view illustrating the appearance of a printer according to the invention.
Figure 2:
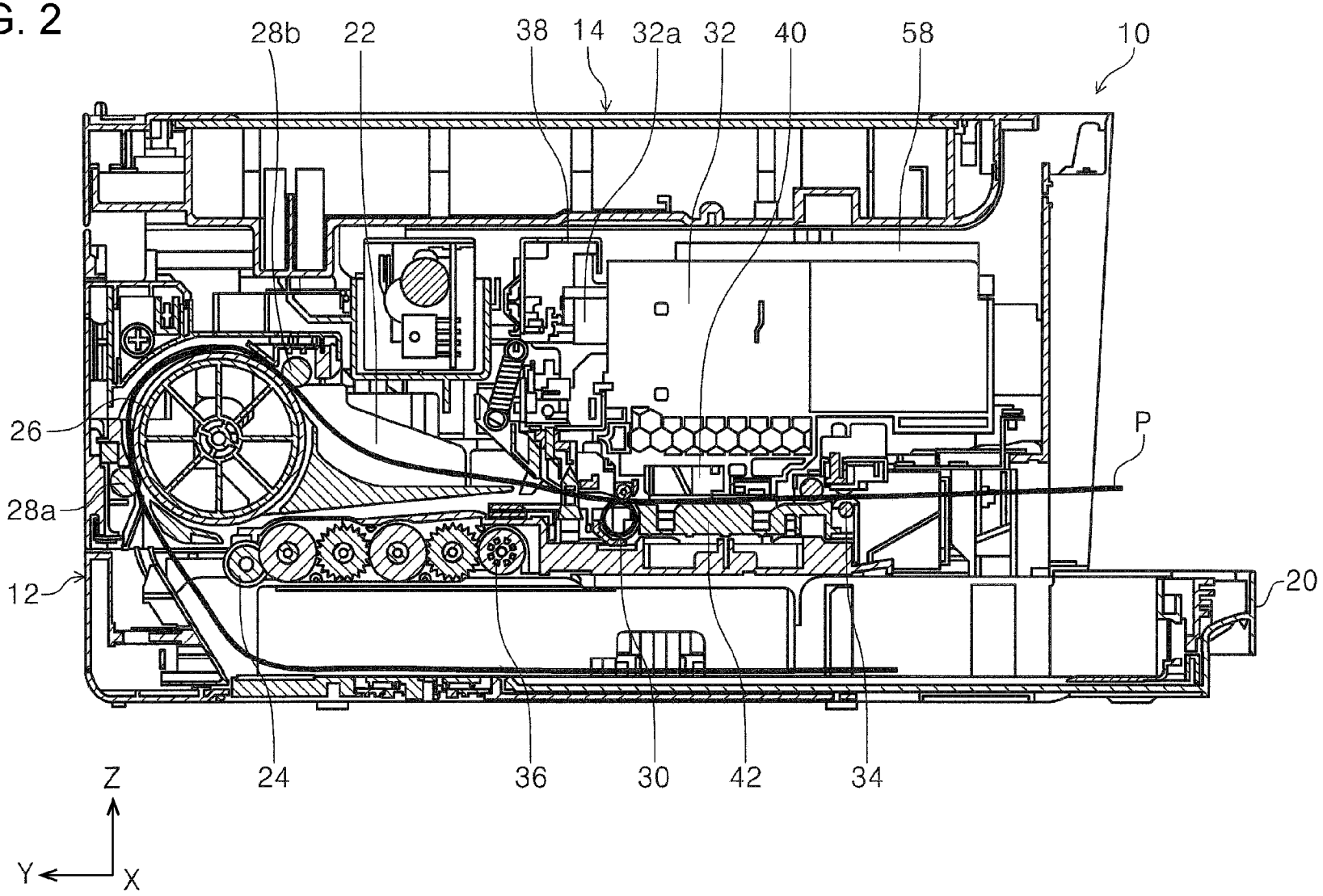
FIG. 2 is a side sectional view illustrating a medium transport path in the printer according to the invention.
Figure 3:
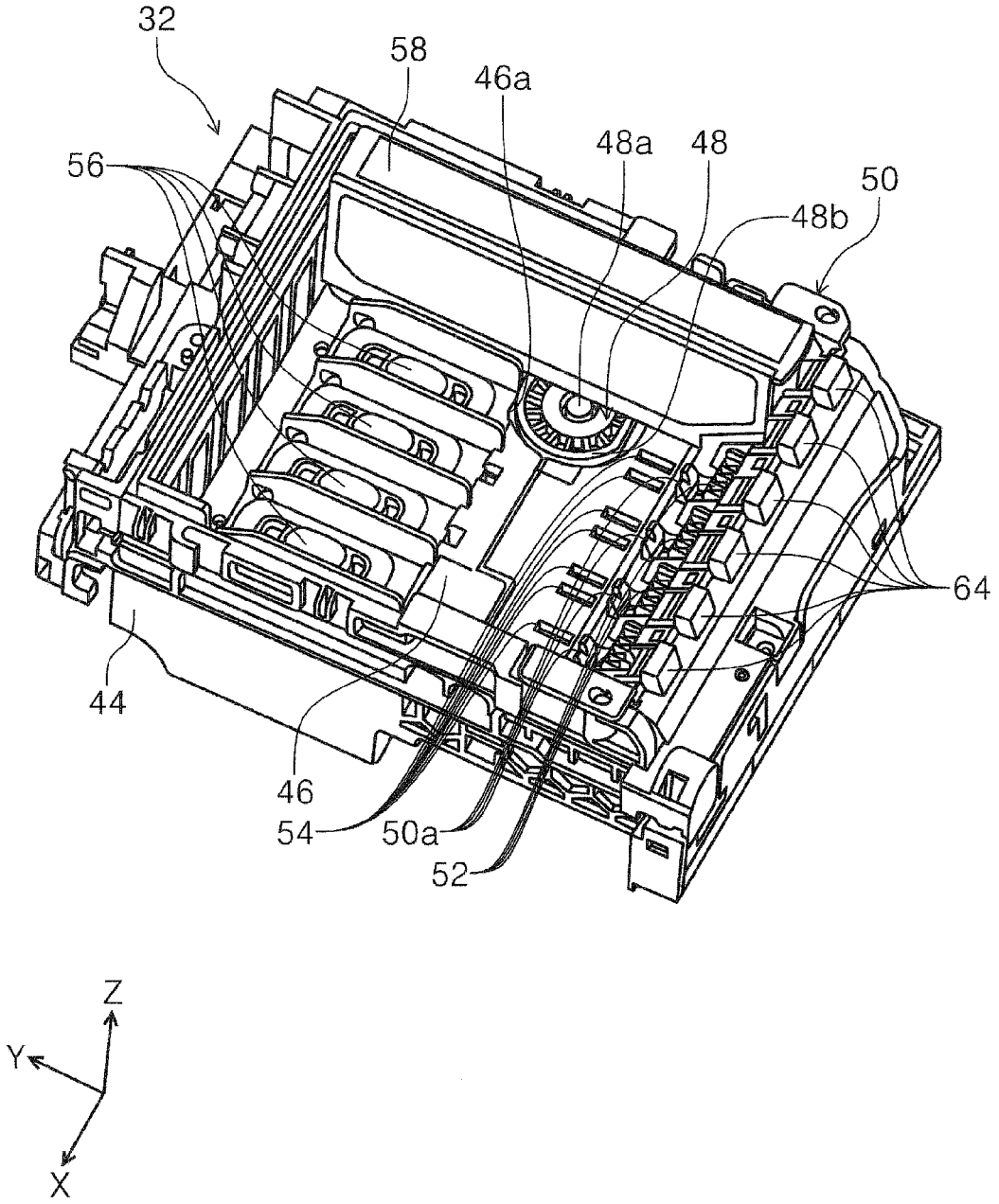
FIG. 3 is a perspective view illustrating a carriage according to a first example.
Figure 4:
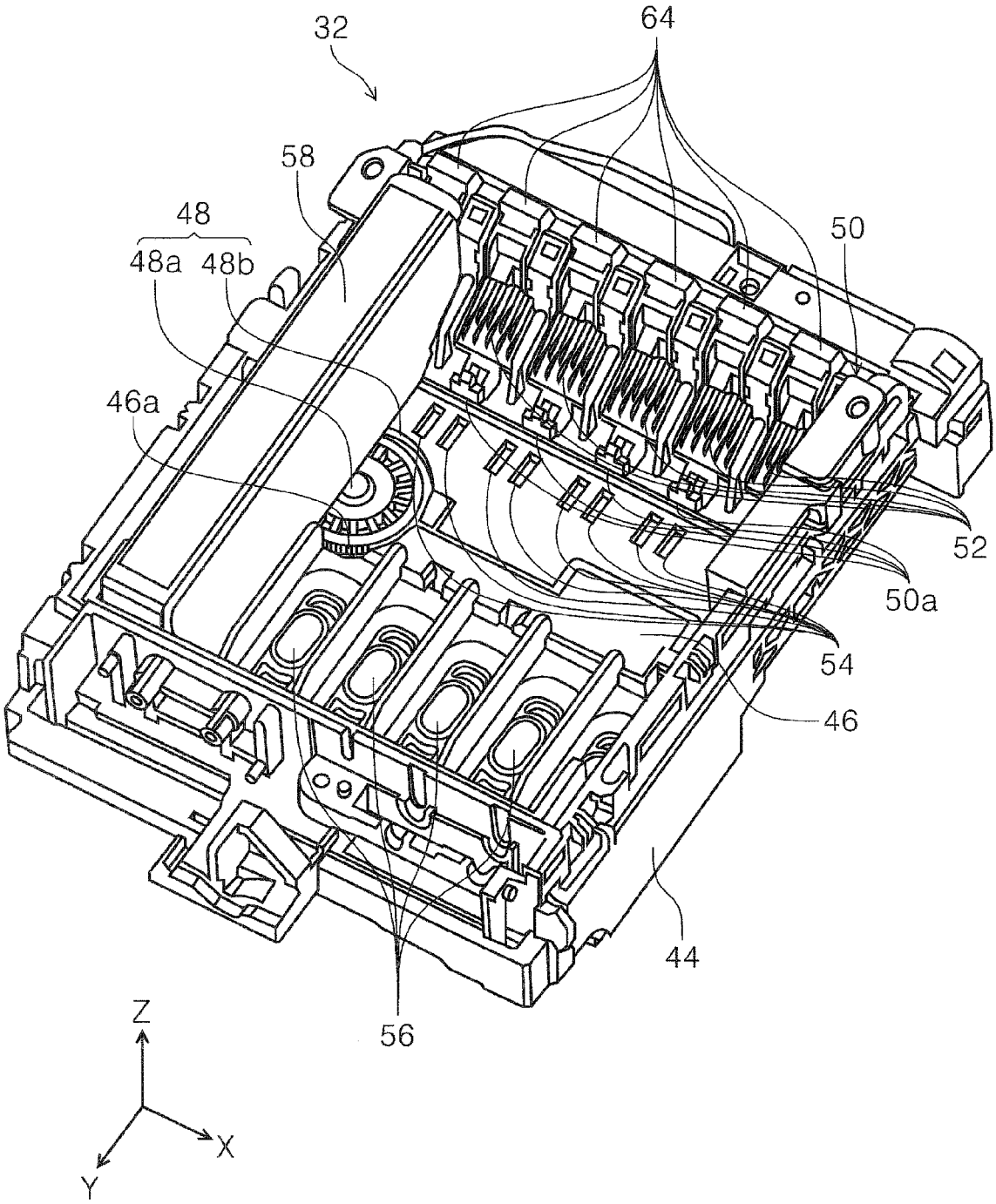
FIG. 4 is a perspective view illustrating the carriage according to the first example.
Figure 5:
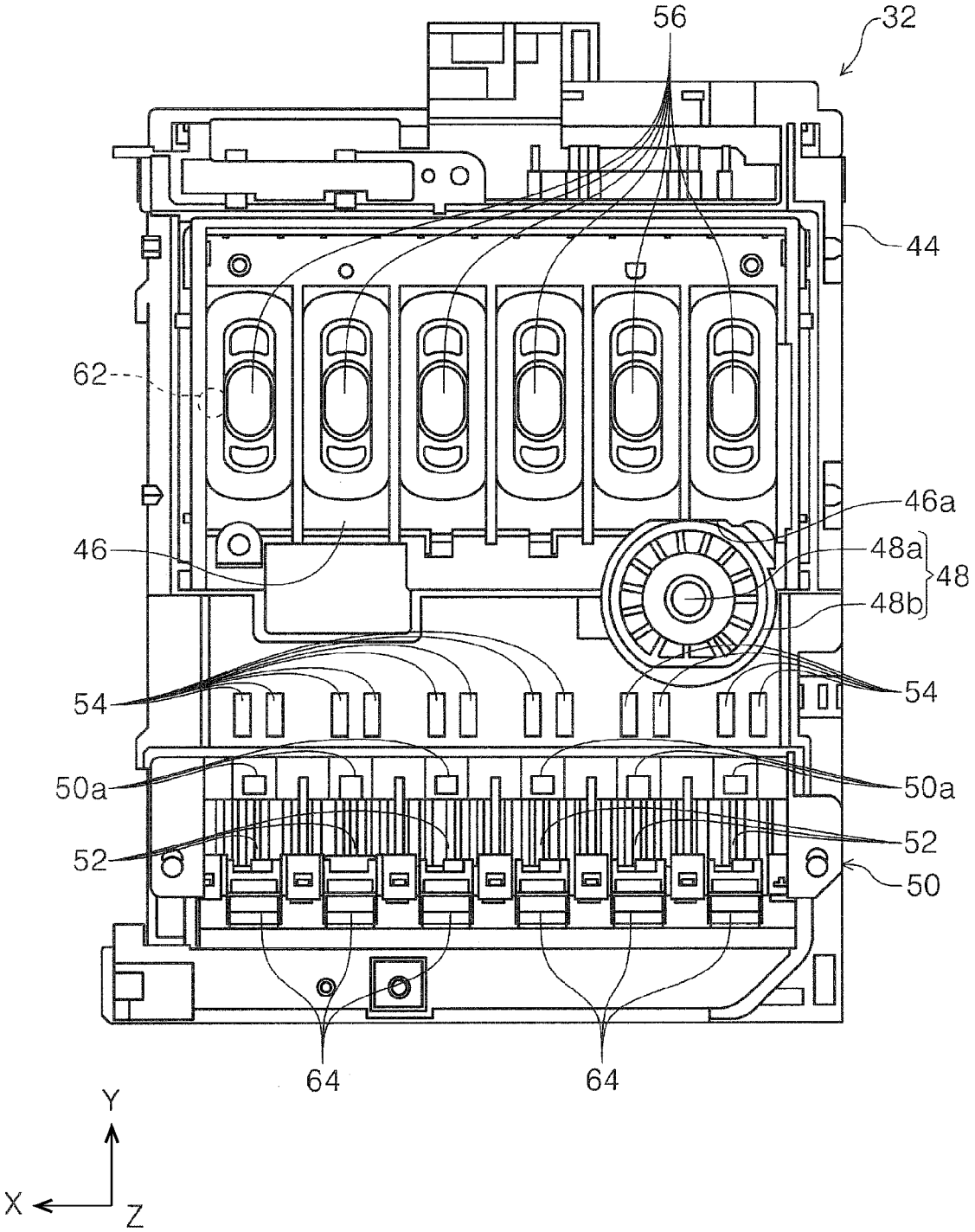
FIG. 5 is a plan view illustrating the carriage according to the first example.

FIG. 1 is a perspective view illustrating the appearance of a printer according to the invention. FIG. 2 is a side sectional view illustrating a medium transport path in the printer according to the invention. FIG. 3 is a perspective view illustrating a carriage according to the first example. FIG. 4 is a perspective view illustrating the carriage according to the first example. FIG. 5 is a plan view illustrating the carriage according to the first example.

Figure 6:
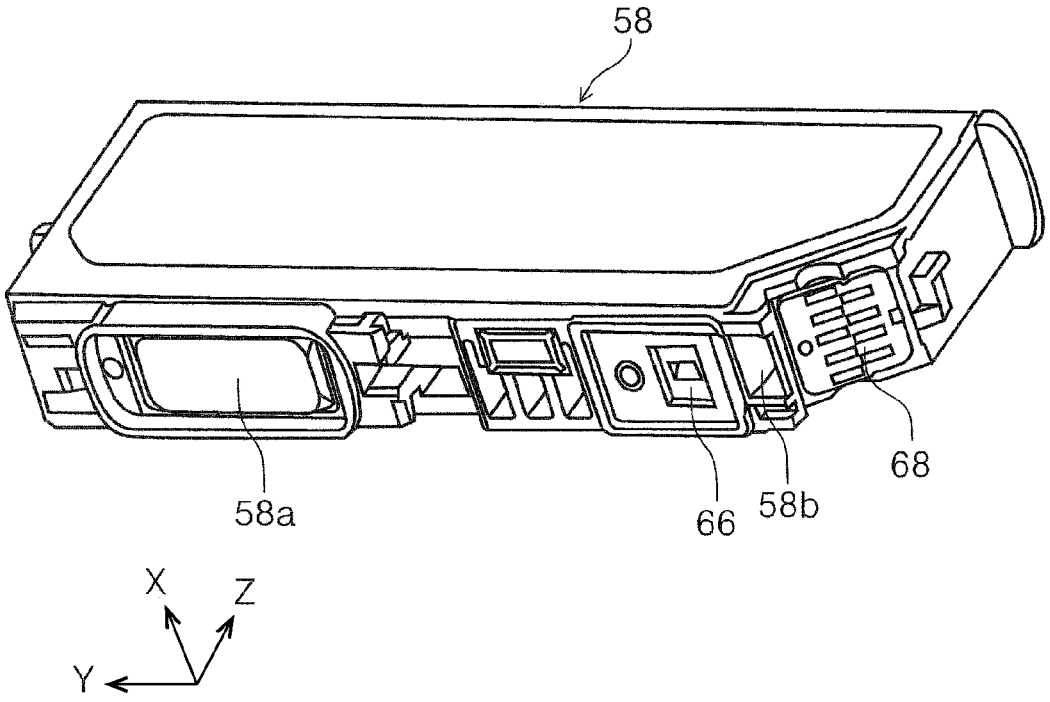
FIG. 6 is a perspective view illustrating an ink cartridge according to the first example.
Figure 7:
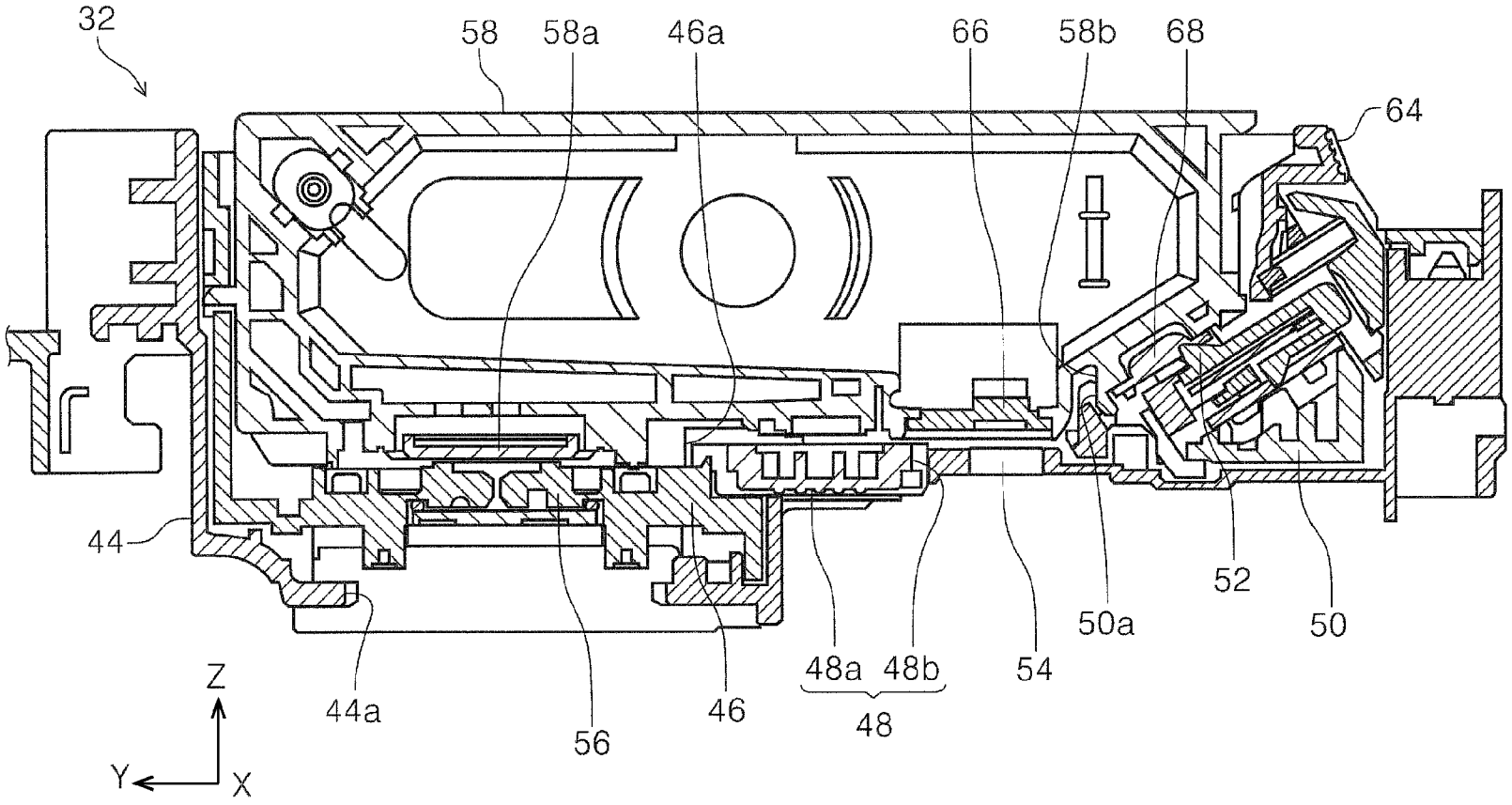
FIG. 7 is a side sectional view illustrating a state in which the ink cartridge is installed in the carriage according to the first example.
Figure 8:
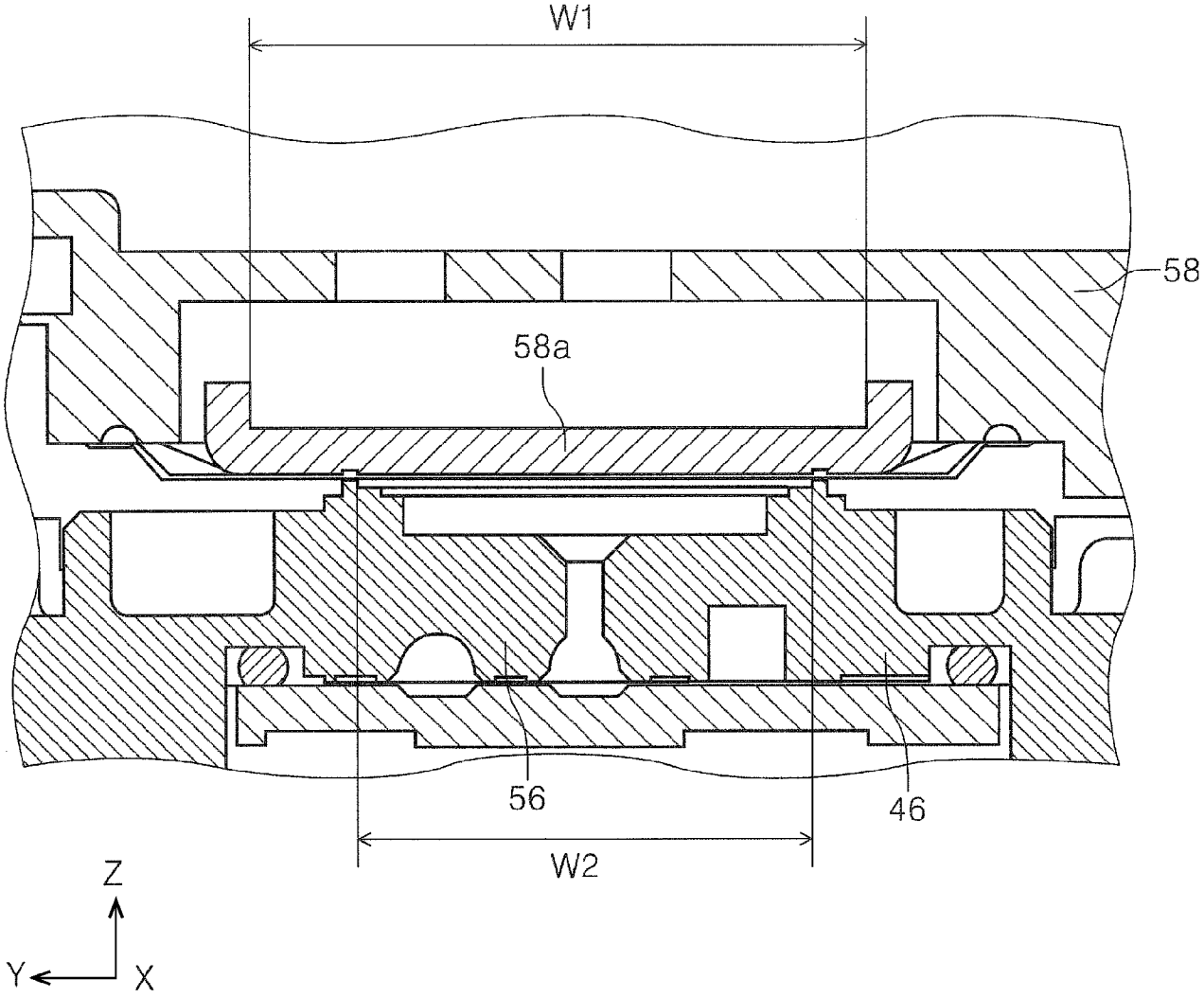
FIG. 8 is a side view illustrating a spatial relationship between an ink receiving portion and an ink supply portion of the ink cartridge in the carriage according to the first example.
Figure 9:
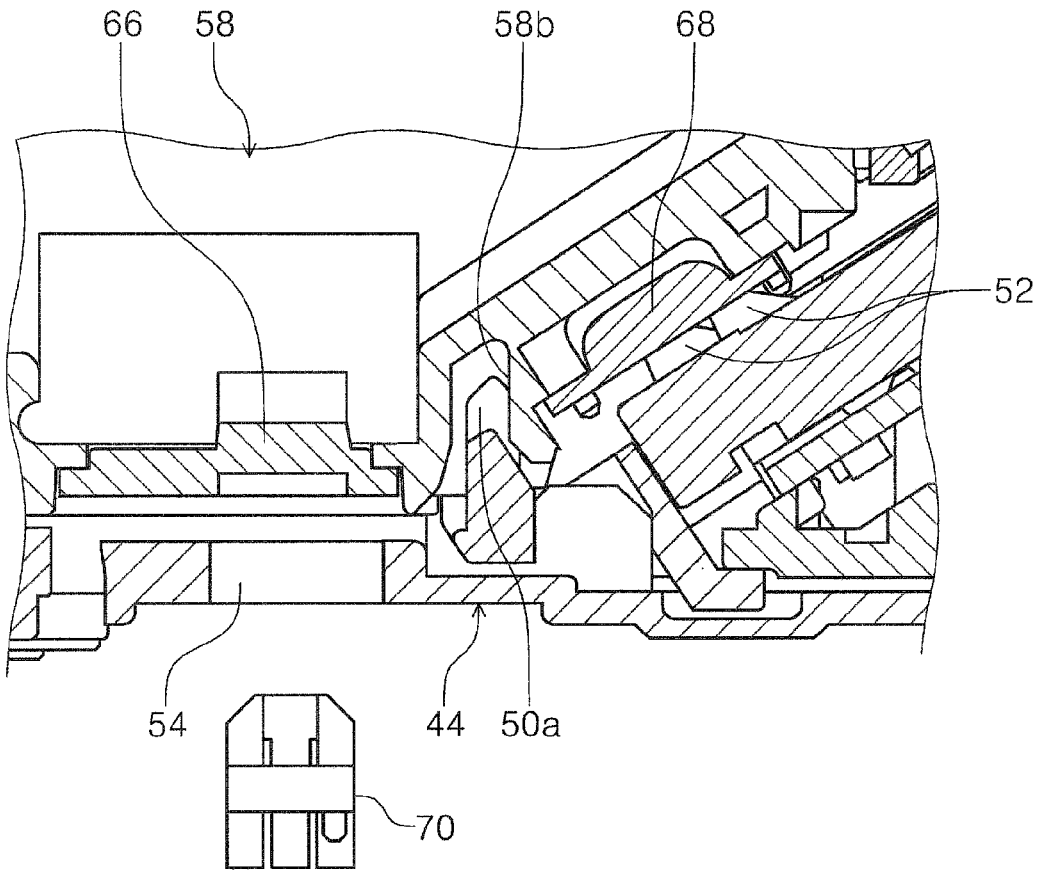
FIG. 9 is a side view illustrating a spatial relationship between a data storage unit of the ink cartridge and contact terminals according to the first example.
Figure 9:
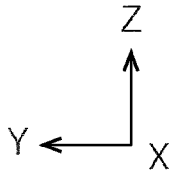
Figure 10:
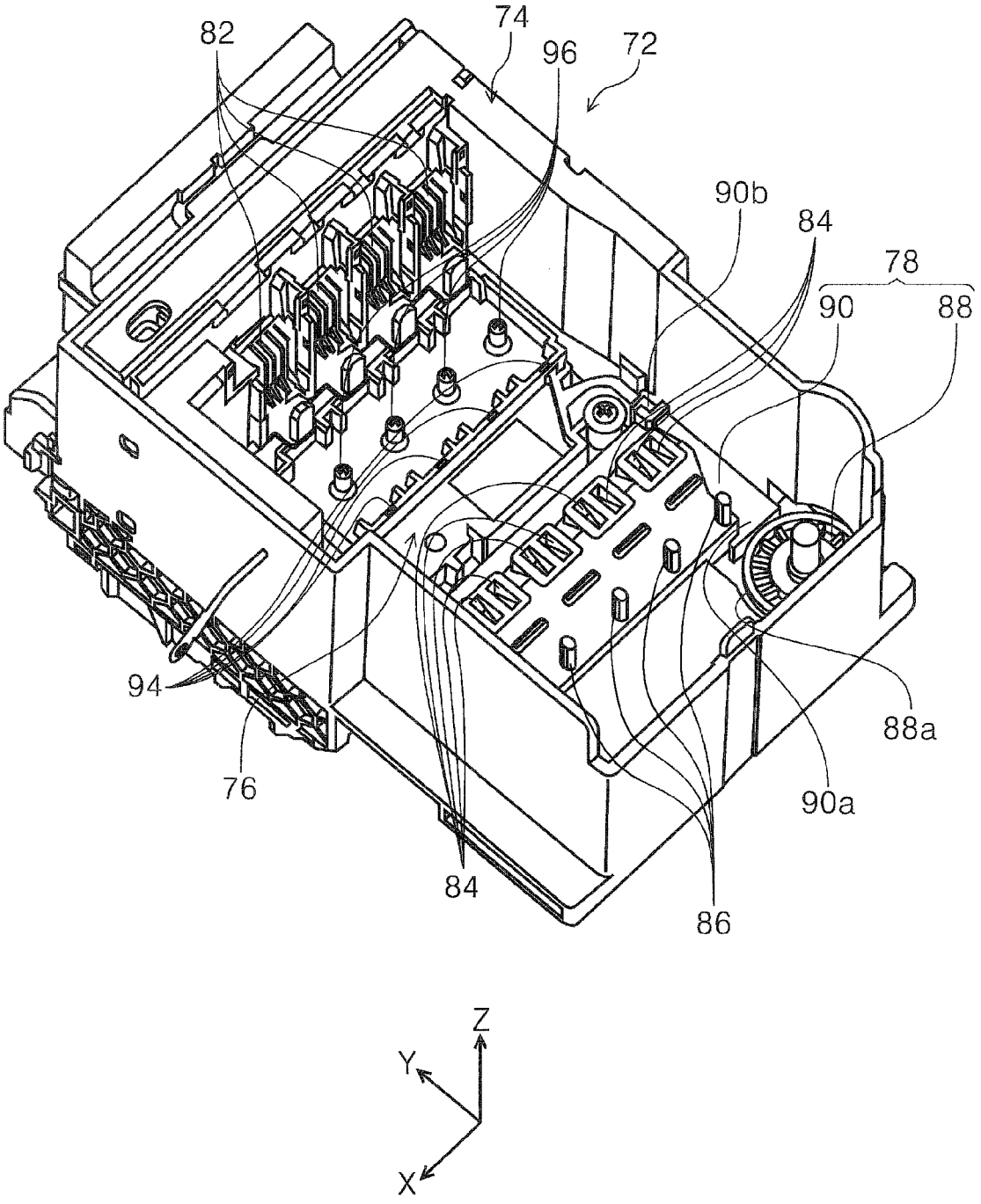
FIG. 10 is a perspective view illustrating a carriage according to a second example.

FIG. 6 is a perspective view illustrating an ink cartridge according to the first example. FIG. 7 is a side sectional view illustrating a state in which the ink cartridge is installed in the carriage according to the first example. FIG. 8 is a side view illustrating a spatial relationship between an ink receiving portion and an ink supply portion of the ink cartridge in the carriage according to the first example. FIG. 9 is a side view illustrating a spatial relationship between a data storage unit of the ink cartridge and contact terminals according to the first example. FIG. 10 is a perspective view illustrating a carriage according to a second example.

Figure 11:
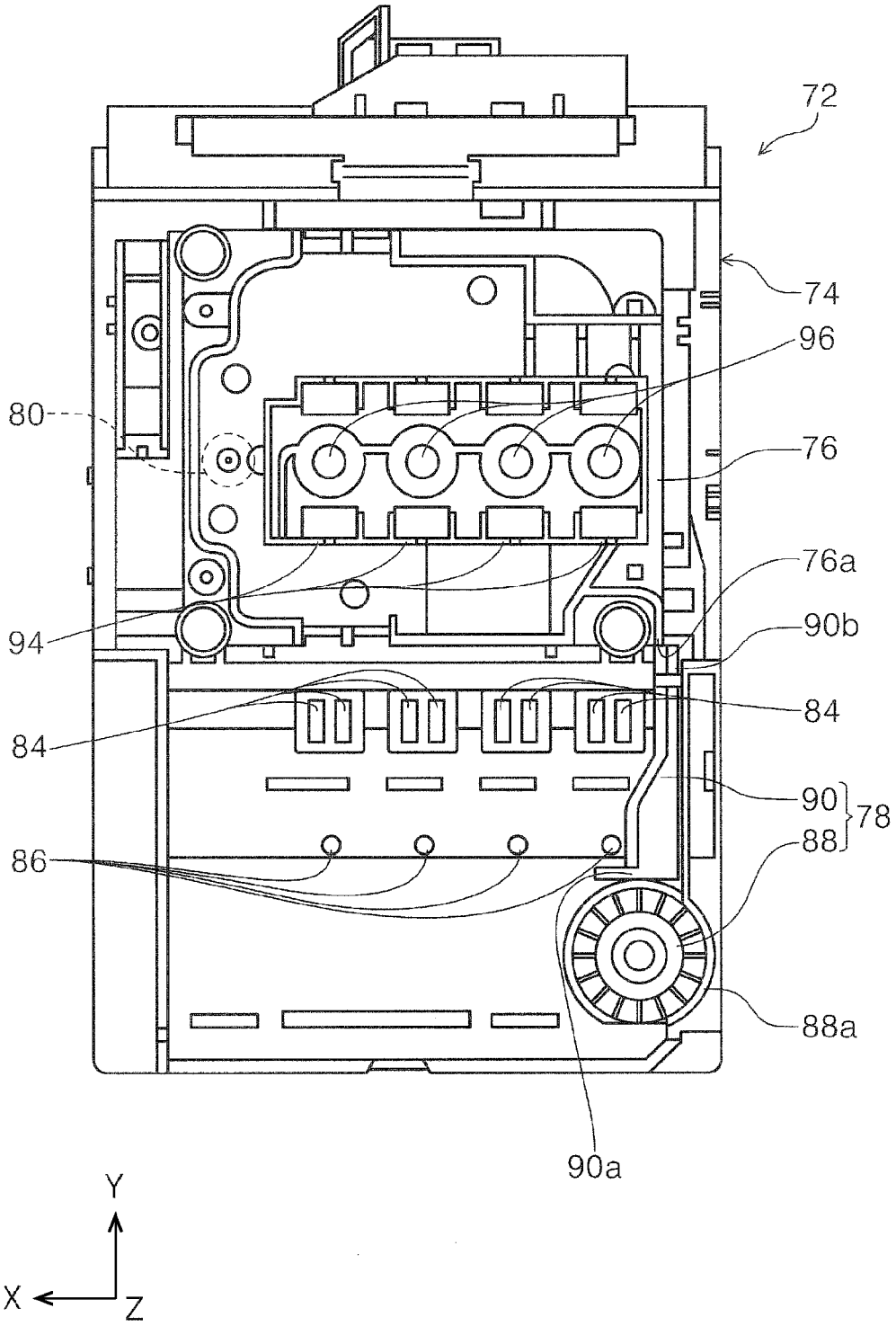
FIG. 11 is a plan view illustrating the carriage according to the second example.
Figure 12:
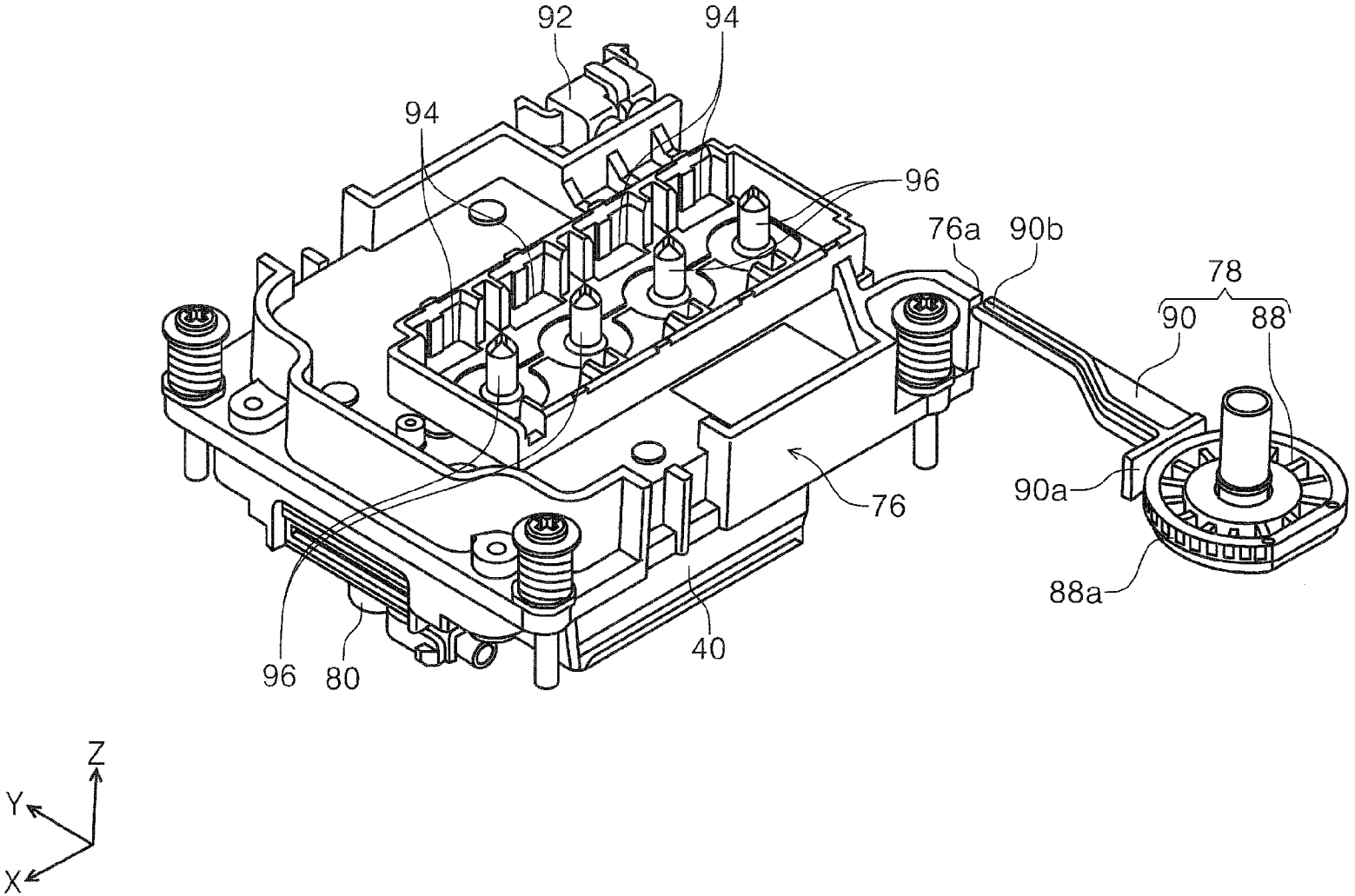
FIG. 12 is a perspective view illustrating a head unit and a turning device according to the second example.
Figure 13:
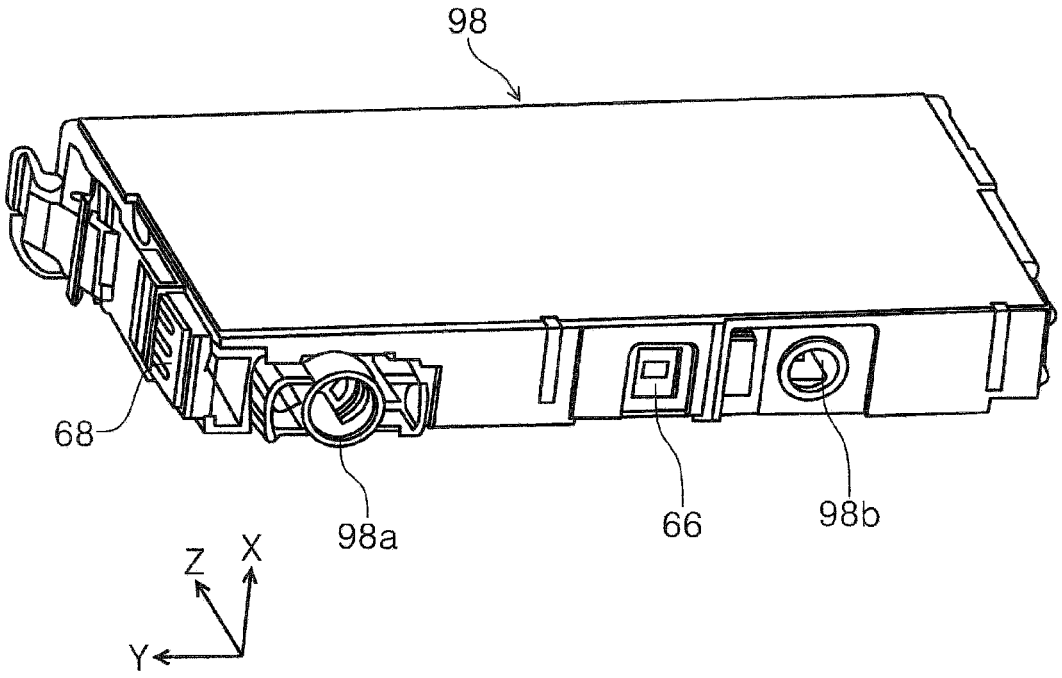
FIG. 13 is a perspective view illustrating an ink cartridge according to the second example.
Figure 14:
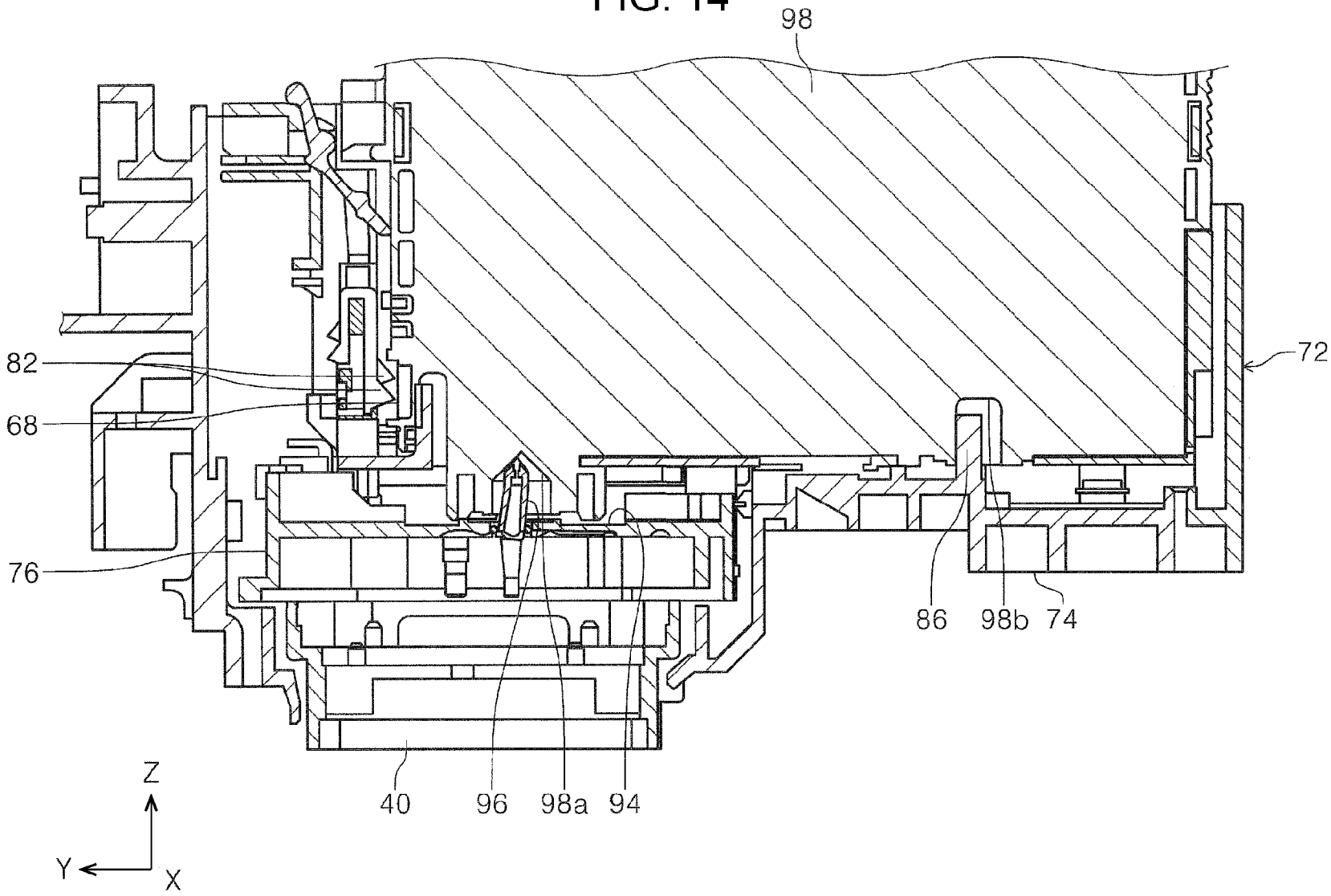
FIG. 14 is a side sectional view illustrating a state in which the ink cartridge is installed in the carriage according to the second example.
Figure 15:
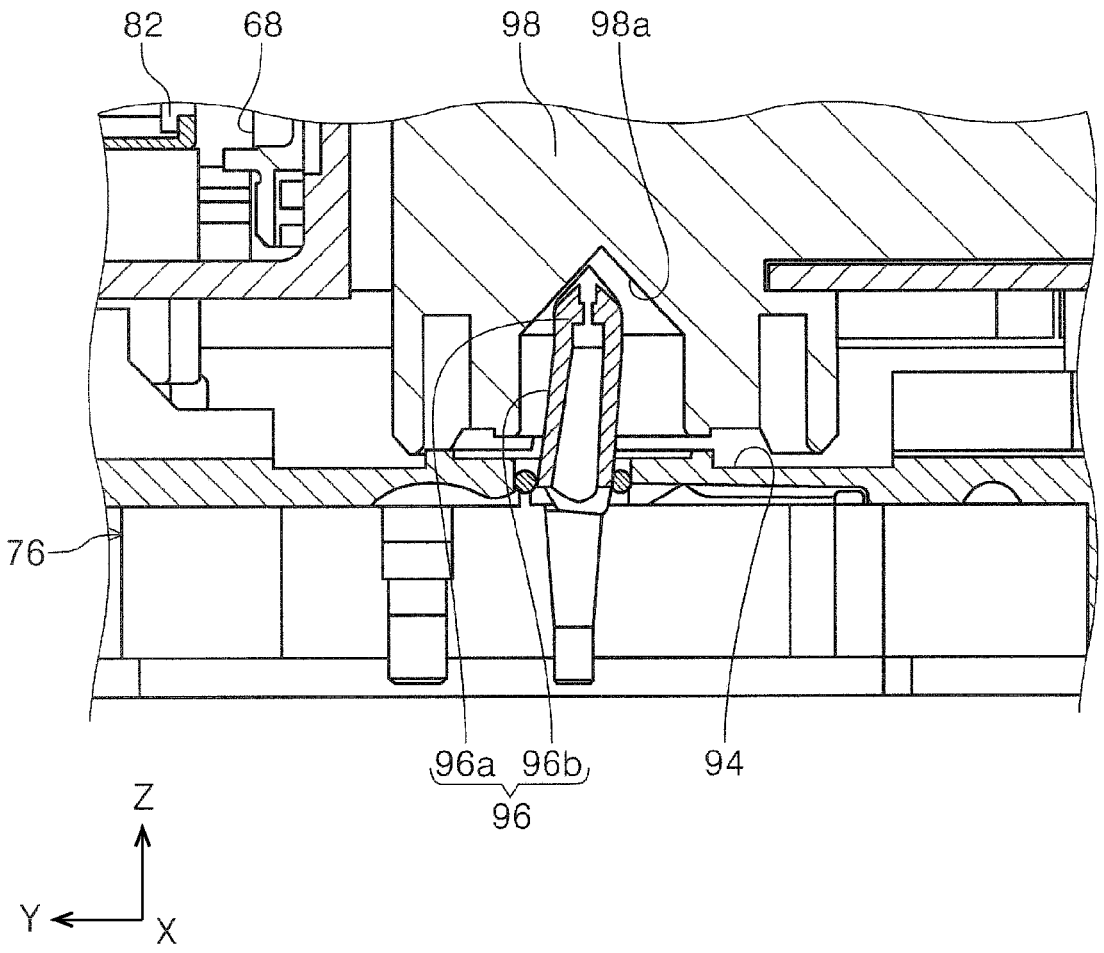
FIG. 15 is a side view illustrating a spatial relationship between an ink receiving portion and an ink supply portion of the ink cartridge in the carriage according to the second example.

FIG. 11 is a plan view illustrating the carriage according to the second example. FIG. 12 is a perspective view illustrating a head unit and a turning device according to the second example. FIG. 13 is a perspective view illustrating an ink cartridge according to the second example. FIG. 14 is a side sectional view illustrating a state in which the ink cartridge is installed in the carriage according to the second example. FIG. 15 is a side view illustrating a spatial relationship between an ink receiving portion and an ink supply portion of the ink cartridge in the carriage according to the second example.

Note that, in the X-Y-Z coordinate system shown in each of the drawings, the X direction represents the main scanning direction (moving direction) of the carriage, i.e., the width direction of the recording apparatus. The Y direction represents the depth direction of the recording apparatus, and the Z direction represents the height direction of the apparatus. In addition, in each of the drawings, the left side of the apparatus is defined as the side in the +X direction and the right side of the apparatus as the side in the −X direction. Similarly, the front side of the apparatus is defined as the side in the −Y direction and the rear side of the apparatus as the side in the +Y direction. The top of the apparatus is defined as the side in the +Z direction and the bottom of the apparatus as the side in the −Z direction.

First Example

Overview of Printer

Referring now to FIG. 1 and FIG. 2, a printer 10 includes an apparatus body 12 and a scanner 14. The apparatus body 12 has an operation panel 16 provided on the front face thereof in the depth direction of the apparatus. The operation panel 16 has input buttons for operating the printer 10 and a display panel for displaying information about the printer 10.

In addition, the apparatus body 12 has a discharge port 18 provided below the operation panel 16 in the front face for discharging a medium P from the apparatus body 12 toward the front side of the apparatus in the depth direction. The apparatus body 12 also has a media container 20 below the discharge port 18. The media container 20 is detachably mounted in the apparatus body 12 in such a manner that the media container 20 can be installed from, or detached toward, the front side of the apparatus in the depth direction of the apparatus. The media container 20 is shaped as a box and can contain a plurality of media therein.

Medium Transport Path

Next, a medium transport path 22 for transporting the medium in the apparatus body 12 will be described with reference to FIG. 2. In FIG. 2, the thick solid line, which is denoted by reference symbol P, represents a path for guiding the medium that is transported along the medium transport path 22 from the media container 20 toward the discharge port 18.

Along the medium transport path 22 in the apparatus body 12, a pickup roller 24, a medium inverting roller 26, idler rollers 28*a*, 28*b*, a transport roller pair 30, a carriage 32, and a discharge roller 34 are provided in this order. The pickup roller 24 is provided above the media container 20 in such a manner that the pickup roller 24 is pivotally movable with a pivot 36 as the fulcrum. The pickup roller 24 feeds a medium from the media container 20. The medium is subsequently nipped by the medium inverting roller 26 and the idler rollers 28*a*, 28*b* and transported to the transport roller pair 30.

The transport roller pair 30 transports the medium toward the carriage 32. A guiding device 38 is provided behind the carriage 32 in the depth direction of the apparatus. The guiding device 38 extends in the width direction of the apparatus. The guiding device 38 guides the carriage 32 in the width direction of the apparatus, which is otherwise referred to as the "predetermined direction". The carriage 32 is formed so as to be able to move reciprocally in the width direction of the apparatus. A recording head 40 is provided at the bottom of the carriage 32. The recording head 40 is formed so as to eject ink, which is otherwise referred to as "liquid", downward in the height direction of the apparatus.

Provided under the recording head 40 in a region opposing the recording head 40 is a medium guiding member 42. The medium guiding member 42 opposes the recording head 40 with a gap therebetween. The medium guiding member 42 supports the bottom face of the medium (a face opposite a recording face of the medium) that has been transported by the transport roller pair 30 to the region opposing the recording head 40. The recording head 40 subsequently performs recording onto the recording face of the medium by ejecting ink onto the medium that is supported by the medium guiding member 42.

The medium onto which recording has been performed is then discharged from the discharge port 18, which is provided on the front side of the apparatus, toward the front of the apparatus body 12 by using the discharge roller 34 that is provided downstream of the carriage 32 in the medium transport direction.

Structure of Carriage

Next, a structure of the carriage 32 will be described with reference to FIG. 3 and FIG. 5. The carriage 32 includes a housing 44 that is shaped as a box and opens upward in the height direction of the apparatus, a head unit 46, a turning device 48, a positioner portion 50, contact terminals 52, and translucent regions 54. Note that the carriage 32 can receive a plurality of ink cartridges 58 (to be described below) that are arranged side by side in the width direction of the apparatus. FIG. 3 and FIG. 4 illustrate a state in which only one of the ink cartridges 58 is mounted.

In the housing 44, the head unit 46 is disposed at the bottom in a rear portion of the housing 44 in the depth direction of the apparatus. The recording head 40 is attached to the bottom of the head unit 46 (see FIG. 2). Incidentally, a plurality of nozzles that can eject ink are arranged on the bottom surface of the recording head 40 (not shown).

A plurality of ink receiving portions 56, which are otherwise referred to as "receiving portions", are arranged on the top portion of the head unit 46 with appropriate spacings therebetween in the width direction of the apparatus. The ink receiving portions 56 abut, and come into areal contact with, ink supply portions 58*a*, which are otherwise referred to as "liquid supply portions (supply portions)", of the ink cartridges 58 (to be described below), thus receiving ink supplied from the ink cartridges 58. The ink receiving portions 56 supply ink to the nozzles of the recording head 40 via fluid channels (not shown) provided in the head unit 46.

Moreover, as illustrated in FIG. 5, the head unit 46 is pivotably attached to the housing 44 and turnable with a pivot shaft 62 as the fulcrum. The pivot shaft 62 is provided in a left end portion of the housing 44 in the width direction of the apparatus. The housing 44 has an opening 44*a* (see FIG. 7) at the bottom thereof. The head unit 46 is formed such that the recording head 40 attached to the bottom of the head unit 46 protrudes from the opening 44*a* when the head unit 46 is attached to the housing 44. In addition, a recessed engaging portion (pressed portion) 46*a* is provided in the head unit 46 in a front portion of the head unit 46 in the depth direction of the apparatus and in a right edge portion of the head unit 46 in the width direction of the apparatus.

As illustrated in FIG. 5, the turning device 48 is provided on the bottom of the housing 44 at a position opposing the recessed engaging portion (pressed portion) 46*a*. The turning device 48 is formed as a disc-shaped eccentric cam in which the radial distance between the rotation center 48*a* and the peripheral surface 48*b* varies in the peripheral direction. The peripheral surface 48*b* is formed, for example, as a cam surface.

The peripheral surface 48*b* presses the recessed engaging portion (pressed portion) 46*a* of the head unit 46. Note that in FIG. 5, the head unit 46 is urged by an urging device (not shown) provided in the housing 44 in the clockwise direction, with the pivot shaft 62 as the fulcrum. Thus, the head unit 46 presses the turning device 48.

Rotating the turning device 48 about the rotation center 48*a* causes its radial distance to vary. Thereby, in FIG. 5, the turning device 48 can turn the head unit 46 clockwise or counterclockwise, with the pivot shaft 62 as the fulcrum, against an urging force applied by the urging device (not shown).

Returning now to FIG. 3 and FIG. 5, the housing 44 has the positioner portion 50 provided on a front portion of the housing 44 in the depth direction of the apparatus. In the positioner portion 50, a plurality of the contact terminals 52 are arranged with appropriate spacings therebetween in the width direction of the apparatus. Note that the spacings between the contact terminals 52 correspond to the spacings between the ink receiving portions 56 in the head unit 46.

In addition, the positioner portion 50 has a plurality of levers 64. Each of the levers 64 is disposed at a position in the width direction of the apparatus where each of the contact terminals 52 is provided. For example, each of the levers 64 is formed so as to secure an ink cartridge 58 to the housing 44 when the ink cartridge 58 is inserted into the housing 44 from above the housing 44 in the height direction of the apparatus. Moreover, each of the levers 64 is formed so as to be able to exit, by pressing the lever 64, the state in which the ink cartridge 58 is installed into and secured to the housing 44.

In addition, the positioner portion 50 has a plurality of positioner pins 50*a* provided at positions deeper than the contact terminals 52 in the depth direction of the apparatus. A plurality of the positioner pins 50*a* are disposed in the width direction of the apparatus at respective positions where the contact terminals 52 are provided.

A plurality of the translucent regions 54 are provided on the bottom of the housing 44 at positions between the ink receiving portions 56 and the positioner portion 50 in the depth direction of the apparatus. A plurality of the translucent regions 54 are provided, for example, at positions corresponding to the positions of a plurality of the ink receiving portions 56 in the width direction of the apparatus. Note that the turning device 48 is also disposed between the ink receiving portions 56, i.e., the head unit 46 and the positioner portion 50 in the depth direction of the apparatus.

Ink Cartridge

Next, the ink cartridge 58 will be described with reference to FIG. 6. The ink cartridge 58 is formed as a liquid cartridge for containing ink. At the bottom of the ink cartridge 58, there are provided, from the rear side toward the front side of the apparatus in the depth direction, an ink supply portion 58*a*, which is otherwise referred to as a "liquid supply portion (supply portion)", a prism 66, and a positioner-engaging portion 58*b*. In addition, a data storage unit 68 is attached to the ink cartridge 58 in a front portion of the ink cartridges 58 in the depth direction of the apparatus and at a position closer to the bottom. The data storage unit 68 is inclined with respect to the depth direction of the apparatus.

The ink supply portion 58*a* is formed so as to supply the ink contained in the ink cartridge 58 to the recording head 40 via an ink receiving portion 56 of the head unit 46 while the ink supply portion 58*a* is in close contact with the ink receiving portion 56.

The prism 66 is provided in the ink cartridge 58 so as to oppose one of the translucent regions 54 while the ink cartridge 58 is installed in the housing 44. Here, referring to FIG. 9, an optical sensor 70, which projects light to an object and detects the reflected light from the object, is provided in the apparatus body 12. The light projected by the optical sensor 70 passes through the translucent region 54 and enters the prism 66. The prism 66 then reflects the incident light. The reflected light passes through the translucent region 54 and is detected by the optical sensor 70. The optical sensor 70 is configured, for example, to detect a remaining amount of the ink in the ink cartridge 58.

Moreover, the optical sensor 70 can successively detect the prisms of a plurality of the ink cartridges 58 that are installed in the carriage 32 by moving the carriage 32 in the width direction of the apparatus, and thus can detect the remaining amount of ink of each of the ink cartridges 58.

The positioner-engaging portion 58*b* is formed as a concave portion that can accept one of the positioner pins 50*a* of the positioner portion 50 when the ink cartridge 58 is installed into the housing 44. The data storage unit 68 is configured to retain ink cartridge information, such as the amount, color, etc., about the ink contained in the ink cartridge 58.

Installation of Ink Cartridge in Carriage

Next, installation of an ink cartridge 58 in the carriage 32 will be described with reference to FIG. 7. When an ink cartridge 58 is installed into the carriage 32, i.e., the housing 44, from above in the height direction of the apparatus, the ink supply portion 58*a* of the ink cartridge 58 is brought into close contact with an ink receiving portion 56 of the head unit 46. At the same time, a positioner pin 50*a* in the positioner portion 50 enters the positioner-engaging portion 58*b* of the ink cartridge 58 so as to position the ink cartridge 58 with respect to the housing 44.

Subsequently, while the ink supply portion 58*a* is in areal contact with the ink receiving portion 56, the ink within the ink cartridge 58 is supplied to the recording head 40 (see FIG. 2). At this time, the data storage unit 68 of the ink cartridge 58 comes into contact with a contact terminal 52, which establishes electrical connection between the data storage unit 68 and the contact terminal 52. Data stored in the data storage unit 68 are transmitted to a control unit (not shown) disposed within the apparatus body 12.

Here, the orientation of the nozzles disposed at the bottom of the recording head 40 may be adjusted by turning the head unit 46 with respect to the housing 44. The ink cartridge 58, however, has already been positioned with respect to the housing 44 by the positioner pin 50*a*. As a result, the ink supply portion 58*a* of the ink cartridge 58 may relatively deviate from the position of the ink receiving portion 56 of the head unit 46 in a direction intersecting the height direction of the apparatus.

Referring now to FIG. 8, an extent represented by reference symbol W1 in the ink supply portion 58*a* of the ink cartridge 58 indicates an ink supply region from which ink is supplied. Similarly, an extent represented by reference symbol W2 in the ink receiving portion 56 of the head unit 46 indicates an ink receiving region for guiding ink toward the recording head 40. Here, the ink supply region W1 is made, for example, wider than the ink receiving region W2 in the depth direction of the apparatus.

Thus, even if the inclination of nozzles of the recording head 40 is adjusted by turning the head unit 46 with respect to the housing 44, the ink receiving region W2 still stays within the ink supply region W1 because the ink supply region W1 is wider than the ink receiving region W2 so that the areal contact between the ink supply portion 58*a* and the ink receiving portion 56 is maintained. In other words, the ink supply from the ink cartridge 58 to the recording head 40 is still maintained in the state in which the ink supply portion 58*a* is relatively displaced with respect to the ink receiving portion 56 in a turning direction of the head unit 46, i.e., in the state in which the head unit 46 is turned with respect to the housing 44.

On the other hand, as illustrated in FIG. 9, the ink cartridge 58 is already positioned and installed with respect to the housing 44 by the positioner pin 50*a*. Therefore, even if the head unit 46 is turned with respect to the housing 44, the positional relationship between the ink cartridge 58 and the housing 44 does not change, or, if it changes, the change can be suppressed to a small amount. Thereby, good contact conditions between the data storage unit 68 of the ink cartridge 58 and the contact terminal 52 of the positioner portion 50 of the carriage 32 can be maintained.

Moreover, relative positional deviation between the prism 66 of the ink cartridge 58 and the translucent region 54 of the housing 44 can also be suppressed to a small amount. Thereby, good detection conditions between the optical sensor 70 and the prism 66 can be maintained.

In other words, even in the case that when the inclination of nozzles of the recording head 40 is adjusted by turning the head unit 46 with respect to the housing 44, the amount of the inclination adjustment becomes large or the distance between nozzle rows are large, the relative positional deviation between the data storage unit 68 and the contact terminal 52 as well as the relative positional deviation between the prism 66 and the translucent region 54 can be made small. Thus, the good contact conditions and detection conditions can be maintained while maintaining the ink supply from the ink cartridge 58 to the recording head 40.

Second Example

Now, a carriage 72 according to the second example will be described with reference to FIG. 10 and FIG. 15. The carriage 72 includes a housing 74 that is shaped as a box and opens upward in the height direction of the apparatus, a head unit 76, and a turning device 78. Note that the carriage 72 can also receive a plurality of ink cartridges 98 (to be described below) that are arranged side by side in the width direction of the apparatus.

On the bottom of the housing 74, the head unit 76 is pivotably attached to the housing 74 and turnable with a pivot shaft 80 (see FIG. 11) as the fulcrum. The recording head 40 is attached to the bottom of the head unit 76 (see FIG. 12).

A plurality of the contact terminals 82 are provided in a rear portion of the housing 74 in the depth direction of the apparatus. The contact terminals 82 are arranged with appropriate spacings therebetween in the width direction of the apparatus. In addition, a plurality of translucent regions 84 are provided on the bottom of the housing 74 in front of the head unit 76 in the depth direction of the apparatus, and positioner portions 86 are also provided in front of the translucent regions 84. The positioner portions 86 are formed, for example, as positioner pins.

The turning device 78 is provided in a front portion of the housing 74 in the depth direction of the apparatus. The turning device 78 includes a cam portion 88 and a transfer portion 90. The turning device 88 is formed as a disc-shaped eccentric cam in which the radial distance between the rotation center and the peripheral surface 88*a* varies in the peripheral direction. The peripheral surface 88*a* is formed, for example, as a cam surface. Note that the turning device 78 may be disposed between the head unit 76 and the positioner portions 86 in the depth direction of the apparatus, as is in the first example.

The transfer portion 90 includes an abutting portion 90*a* that abuts the peripheral surface (cam surface) 88*a* of the cam portion 88 and a pressing portion 90*b* that presses the head unit 76. The transfer portion 90 extends from the abutting portion 90*a* to the pressing portion 90*b* in the depth direction of the apparatus. In addition, the width of the transfer portion 90 near the pressing portion 90*b* is made smaller than that near the abutting portion 90*a* lest the transfer portion 90 interfere with the translucent regions 84 that are disposed between the head unit 76 and the cam portion 88.

The pressing portion 90*b* of the transfer portion 90 abuts a pressed portion 76*a* that is provided at the right end, in the width direction of the apparatus, and at the front edge, in the depth direction of the apparatus, of the head unit 76. In addition, an urging device 92 is provided in the housing 74 at the right end, in the width direction of the apparatus, and in a rear portion, in the depth direction of the apparatus, of the housing 74. The urging device 92 urges the head unit 76 at the right end, in the width direction of the apparatus, and at the rear edge, in the depth direction of the apparatus, of the head unit 76. The urging device 92 urges the head unit 76 toward the front side of the apparatus in the depth direction.

By rotating the cam portion 88 in a direction in which the distance between the rotation center of the cam portion 88 and the abutting portion 90*a* of the transfer portion 90 increases, the transfer portion 90 moves toward the rear side of the apparatus in the depth direction, and the pressing portion 90*b* presses the pressed portion 76*a* of the head unit 76 toward the rear side of the apparatus. Thus, in FIG. 11, the head unit 76 is turned counterclockwise with the pivot shaft 80 as the turning center against an urging force applied by the urging device 92. On the other hand, if the cam portion 88 is rotated in a direction in which the distance between the rotation center of the cam portion 88 and the abutting portion 90*a* of the transfer portion 90 decreases, the transfer portion 90 moves toward the front side of the apparatus in the depth direction. Thus, in FIG. 11, the head unit 76 is turned clockwise with the pivot shaft 80 as the turning center due to the urging force applied by the urging device 92.

Accordingly, operating the cam portion 88 enables the head unit 76 to turn with the pivot shaft 80 as the turning center. Thus, the position of a plurality of nozzles disposed at the recording head 40 (see FIG. 14) can be adjusted.

Ink Receiving Portion in Head Unit

Referring now to FIGS. 12, 14, and 15, the head unit 76 has a plurality of ink receiving portions 94 with appropriate spacings therebetween in the width direction of the apparatus. Each of the ink receiving portions 94 has an ink receiving stylus 96. The ink receiving stylus 96 has elasticity. More specifically, the ink receiving stylus 96 has a stylus portion 96*a* and an elastic portion 96*b*. The elastic portion 96*b*, for example, is formed of an elastic material and protrudes from each of the ink receiving portions 94. The stylus portion 96*a* is attached to the tip of the elastic portion 96*b*.

Ink Cartridge

An ink cartridge 98 will be described with reference to FIG. 13. The ink cartridge 98 is also formed as a liquid cartridge for containing ink. At the bottom of the ink cartridge 98, there are provided, from the rear side toward the front side of the apparatus in the depth direction, an ink supply portion 98*a*, which is otherwise referred to as a "liquid supply portion (supply portion)", a prism 66, and a positioner-engaging portion 98*b*. In addition, a data storage unit 68 is attached to the ink cartridge 98 at a position closer to the bottom in a rear portion of the ink cartridge 98 in the depth direction of the apparatus.

Installation of Ink Cartridge in Carriage

Next, installation of an ink cartridge 98 in the carriage 72 will be described with reference to FIG. 14 and FIG. 15. When an ink cartridge 98 is installed into the carriage 72, i.e., the housing 74, from above in the height direction of the apparatus, the ink receiving stylus 96 of one of the ink receiving portions 94 of the head unit 76 enters the ink supply portion 98*a* of the ink cartridge 98. Ink is thereby supplied from the ink supply portion 98*a* via the ink receiving stylus 96 to the recording head 40. At the same time, one of the positioner portions 86 enters the positioner-engaging portion 98*b* of the ink cartridge 98, thereby positioning the ink cartridge 98 with respect to the housing 74. The data storage unit 68 comes into contact with one of the contact terminals 82 so as to establish electrical connection.

When the ink cartridge 98 is installed into the housing 74 in the state in which the head unit 76 is turned with respect to the housing 74, the ink receiving stylus 96, which has elasticity, follows the shape of the ink supply portion 98*a* of the ink cartridge 98 and enters the ink supply portion 98*a* deeply. Thus, the ink supply from the ink cartridge 98 to the recording head 40 is established.

Here, the ink cartridge 98 is positioned with respect to the housing 74 when it is installed into the housing 74. Thus, even if the head unit 76 is turned with respect to the housing 74, the relative positional deviation between the data storage unit 68 and the contact terminal 82 can be suppressed to a small amount. Similarly, the relative positional deviation between the prism 66 of the ink cartridge 98 and the translucent region 84 of the housing 74 can also be suppressed to a small amount.

Thus, good contact conditions between the data storage unit 68 and the contact terminal 82 as well as good detection conditions between the optical sensor 70 and the prism 66 can be maintained while maintaining the ink supply from the ink cartridge 98 to the recording head 40.

Modifications of Second Example

In the present example, the elastic portion 96*b* is provided in the ink receiving stylus 96, which is on the carriage 72 side. However, instead of adopting this feature, the ink supply portion 98*a* of the ink cartridge 98 may have elasticity so that the ink supply portion 98*a* follows the shape of the ink receiving stylus 96 when the ink cartridge 98 is installed into the carriage 72.

In summary, the printer 10 has the carriage 32 or 72 that includes the recording head 40 that performs recording onto a medium and can move in the predetermined direction. The printer 10 also has the guiding device 38 that guides the carriage 32 or 72. In addition, the carriage 32 or 72 includes the housing 44 or 74 and the head unit 46 or 76 that includes the recording head 40. In the housing 44 or 74 that is guided by the guiding device 38, the head unit 46 or 76 is turnable about the pivot shaft 62 or 80 that extends in a direction intersecting the head surface of the recording head 40. The carriage 32 or 72 also includes the positioner portion 50 or 86 that is fixed to the housing 44 or 74, and the positioner portion 50 or 86 defines the position of the ink cartridge 58 or 98 that contains ink within the carriage 32 or 72. The ink cartridge 58 or 98 includes the data storage unit 68 that retains information about the ink cartridge 58 or 98. The contact terminal 52 or 82 that is brought into contact with the data storage unit 68 when the ink cartridge 58 or 98 is installed into the carriage 32 or 72 is provided in the housing 44 or 74 instead of being included in the head unit 46 or 76. In other words, the contact terminal 52 or 82 is provided outside the head unit 46 or 76.

With the above configuration, by providing the positioner portion 50 or 86 that is attached to the housing 44 or 74 and defines the position of the ink cartridge 58 or 98 within the carriage 32 or 72 and by providing the contact terminal 52 or 82, which is brought into contact with the data storage unit 68 disposed in the ink cartridge 58 or 98, outside the head unit 46 or 76 within the housing 44 or 74, the positional relationship between the data storage unit 68 disposed in the ink cartridge 58 or 98 and the contact terminal 52 or 82 does not change, or, if it changes, the change can be suppressed to a small amount, even when the head unit 46 or 76 is turned. In other words, the good contact between the data storage unit 68 and the contact terminal 52 or 82 can be maintained without dividing the carriage 32 or 72 into two separate units. Thus, the good contact between the data storage unit 68 and the contact terminal 52 or 82 can be maintained while suppressing an increase in the size and cost of the carriage 32 or 72.

The head unit 46 or 76 has the ink receiving portion 56 or 94 that is connected to the ink supply portion 58*a* or 98*a*, and the ink supply portion 58*a* or 98*a* of the ink cartridge 58 or 98 and the ink receiving portion 56 or 94 are allowed to be displaced from each other at least in a turning direction of the head unit 46 or 76. With this configuration, damage to the ink supply portion 58*a* or 98*a* or the ink receiving portion 56 or 94 occurring when the head unit 46 or 76 is turned can be avoided.

The ink supply portion 58*a* supplies ink to the ink receiving portion 56 with the ink supply portion 58*a* in areal contact with the ink receiving portion 56. In addition, the ink supply region W1 in the ink supply portion 58*a* is larger than the ink receiving region W2 in the ink receiving portion 56, and the ink receiving region W2 is located within the ink supply region W1 when the ink supply portion 58*a* is in contact with the ink receiving portion 56. With this configuration, even if the head unit 46 is turned, ink is smoothly supplied from the ink supply portion 58*a* to the ink receiving portions 56.

The ink receiving portion 94 has the ink receiving stylus 96 that is inserted into the ink supply portion 98*a* so as to receive ink, and the ink receiving stylus 96 has elasticity. With this configuration, even if the head unit 76 is turned, the state in which the ink receiving stylus 96 is inserted in the ink supply portion 98*a* can be maintained, which enables the ink supply portion 98*a* to smoothly supply ink to the ink receiving portions 94.

The translucent region 54 or 84, through which the detection light of the optical sensor 70 enters or exits the housing 44 or 74, is provided in the housing 44 or 74. Here, even if the head unit 46 or 76 is turned, the ink cartridge 58 or 98 is not displaced relative to the housing 44 or 74, and thus the translucent region 54 or 84 and the ink cartridge 58 or 98 are not displaced relative to the optical sensor 70. With this configuration, when detecting the remaining amount of the ink within the ink cartridge 58 or 98 by using the detection light, negative impact on the detection posed by the turning of the head unit 46 or 76 can be circumvented.

The carriage 32 has the turning device 48 for turning the head unit 46 about the pivot shaft 62. In addition, the turning device 48 and the translucent region 54 are provided between the ink receiving portion 56 and the positioner portion 50 in the carriage 32 when viewed in plan view. With this configuration, the space available between the head unit 46 and the positioner portion 50 can be utilized effectively by disposing the turning device 48 and the translucent region 54 in the space, which can prevent an increase in the size of the carriage 32.

In the present embodiment, the carriage 32 or 72 according to the invention is applied to the ink jet printer, which is an example of the recording apparatus. However, the carriage 32 or 72 can be generally applied to other liquid ejecting apparatuses. Here, the liquid ejecting apparatuses are not limited to recording apparatuses, such as printers, copiers, and facsimiles that use an ink-jet type recording head and perform recording onto a recording medium by ejecting ink from the recording head. The liquid ejecting apparatuses also include apparatuses in which a liquid ejecting head, which corresponds to the ink-jet type recording head, ejects liquid, instead of ink, that matches a particular application onto a liquid receiving medium, which corresponds to a recording medium, and adheres the liquid to the liquid receiving medium.

Examples of the liquid ejecting head include, in addition to the recording head, a color material ejecting head that is used in manufacturing color filters for liquid crystal displays, etc., an electrode material (conductive paste) ejecting head that is used for forming electrodes for organic electroluminescence displays, field emission displays (FED), etc., a living organic material ejecting head that is used in manufacturing biochips, and a test material ejecting head that is used as a precision pipet.

It should be understood that the invention is not limited to the examples described above and various modifications can be made within the scope of the invention set forth in the claims. Thus, all such modifications are intended to be included within the scope of this invention.

The entire disclosure of Japanese Patent Application No. 2016-148122, filed Jul. 28, 2016 is expressly incorporated by reference herein.

What is claimed is:

1. A recording apparatus comprising:

a carriage guided by a guiding device and being configured to move in a reciprocating movement direction;

a head unit held by the carriage and including a recording head that records onto a medium;

a contact terminal included in the carriage and configured to be brought into contact with a data storage unit that is mounted on a liquid cartridge that is installable into to the carriage, the data storage unit configured to store information about the liquid cartridge;

a positioner portion included in the carriage and configured to maintain contact between the contact terminal and the data storage unit while the liquid cartridge is installed into the carriage; and an adjustment mechanism that adjusts the position of the head unit with respect to the carriage, within a range in which the receiving portion included in the head unit can be connected to a supply portion included in the liquid cartridge, by turning the head unit about a pivot that extends in a direction intersecting a head surface of the recording head, the head surface having a nozzle for ejecting liquid, wherein the adjustment mechanism includes a turning device formed as a disc-shaped eccentric cam in which a radial distance between a rotation center and a peripheral surface of the cam varies in a peripheral direction.

2. The recording apparatus according to claim 1, wherein the receiving portion has a receiving surface to be brought into areal contact with the supply portion.

3. The recording apparatus according to claim 2, wherein, when the head unit is viewed in a direction intersecting the head surface, the head unit has the pivot at one end thereof and has a pressed portion at another end thereof, and the adjustment mechanism presses the pressed portion so as to turn the head unit about the pivot.

4. The recording apparatus according to claim 3, wherein the head unit has the pivot at one end thereof in the reciprocating movement direction and has the pressed portion at the other end thereof, and the cam presses the pressed portion.

5. The recording apparatus according to claim 1, wherein the receiving portion has a receiving stylus to be inserted into the supply portion so as to receive liquid, and the receiving stylus has elasticity.

6. The recording apparatus according to claim 1, wherein the positioner portion includes a positioner pin provided at a position deeper than the contact terminal in a depth direction of the recording apparatus.

* * * * *